US006266598B1

(12) United States Patent
Pillar et al.

(10) Patent No.: US 6,266,598 B1
(45) Date of Patent: Jul. 24, 2001

(54) CONTROL SYSTEM AND METHOD FOR A SNOW REMOVAL VEHICLE

(75) Inventors: Duane R. Pillar, Oshkosh; Bradley C. Squires, New London, both of WI (US)

(73) Assignee: Oshkosh Truck Corporation, Oshkosh, WI (US)

( * ) Notice: Subject to any disclaimer, the term of this patent is extended or adjusted under 35 U.S.C. 154(b) by 0 days.

(21) Appl. No.: 09/564,763

(22) Filed: May 4, 2000

(51) Int. Cl.[7] ..... G05D 17/02; C06F 7/00; C06F 19/00; C06F 17/00; G05B 6/05

(52) U.S. Cl. ..... 701/54; 701/53; 701/1; 197/197; 197/228; 197/236; 197/249; 197/252; 197/258; 37/259

(58) Field of Search ..... 701/1, 60, 53, 701/54, 101, 50, 58, 65; 477/7; 37/197, 236, 258, 252, 249, 259, 228; 180/305–307

(56) References Cited

U.S. PATENT DOCUMENTS 3,805,421 * 4/1974 Kamlukin et al. ..... 37/43 D
3,886,675 * 6/1975 Malsonneuve et al. ..... 37/25
4,062,135 * 12/1977 Dobberpuhl ..... 37/43 R
4,203,237 * 5/1980 Enters et al. ..... 37/43 E
4,255,879 * 3/1981 Greider ..... 37/43 R
4,391,052 * 7/1983 Guy, Jr. ..... 37/236
4,615,129 * 10/1986 Jackson ..... 37/197
5,090,142 * 2/1992 Peters ..... 37/243
5,174,053 * 12/1992 Takeshita ..... 37/258
5,209,003 * 5/1993 Maxfield et al. ..... 37/252
5,953,837 * 9/1999 Clifford ..... 37/228
6,154,985 * 12/2000 Champagne et al. ..... 37/222

FOREIGN PATENT DOCUMENTS 0 523 966 A1 * 1/1993 (EP) .

* cited by examiner

*Primary Examiner*—William A. Cuchlinski, Jr.
*Assistant Examiner*—Ronnie Mancho
(74) *Attorney, Agent, or Firm*—Foley & Lardner

(57) ABSTRACT

A snow removal vehicle is provided comprising an impeller, an engine system, and an engine control system. The engine control system receives feedback information pertaining to operation of the impeller, and controls the engine system based on the feedback information. A method of controlling a snow removal vehicle is provided comprising acquiring feedback information pertaining to operation of an impeller of the snow removal vehicle, analyzing the feedback information with an electronic signal processor, and controlling forward movement of the snow removal vehicle based on the feedback information.

20 Claims, 4 Drawing Sheets

CONTROL SYSTEM AND METHOD FOR A SNOW REMOVAL VEHICLE

FIELD OF THE INVENTION

The field of the invention is snow removal vehicles. More particularly, the invention relates to a control system and method for a snow removal vehicle.

Snow removal vehicles are commonly employed for removing snow in, for example, municipal and commercial settings. A common type of snow removal vehicle, which is commonly referred to as a "snow blower" vehicle, comprises an impeller or ribbon which is mounted at the front of the vehicle and which is driven by an engine to throw or "blow" snow away from a region of interest. For example, at airports, snow plows are employed to initially plow snow to the side of runways, and then one or more snow blower vehicles are employed to throw the snow further away from the side of the runway (e.g., several hundred feet from the side of the runway). This prevents snow banks from building up along the side of the runway which would hamper further snow removal efforts.

For efficient resource utilization, it is desirable for snow removal vehicles to be able to remove as much snow as possible in as little time as possible. As used herein, the term "efficiency" refers to the amount of snow per unit time (e.g., tons per hour) that a snow removal vehicle is capable of removing. If the vehicle progresses too slowly, then snow intake is reduced and therefore vehicle efficiency is reduced. If the vehicle progresses too quickly, then snow intake exceeds the snow removal capacity of the snow removal vehicle, thereby causing the impeller to stall and causing vehicle efficiency to be reduced to zero until the impeller is cleared.

In practice, it is often difficult for an operator of a snow removal vehicle to operate the snow removal vehicle at maximum efficiency due to varying snow conditions. As the vehicle moves forward, the vehicle is likely to encounter snow of varying density due to variations in snow packing, snow wetness, drifting and so on. Additionally, the operator may encounter patches that have been previously cleared of snow, allowing the vehicle to travel forward much faster. The varying snow conditions affect the rate at which snow can be removed without impeller stalling. What is needed therefore is a control system and method for a snow removal vehicle that can be used to optimize vehicle efficiency.

SUMMARY OF THE INVENTION

According to a first preferred aspect of the invention, a snow removal vehicle is provided comprising an impeller, an engine system, and an engine control system. The engine control system receives feedback information pertaining to operation of the impeller, and controls the engine system based on the feedback information.

According to a second preferred aspect of the invention, a method of controlling a snow removal vehicle is provided. The method comprises acquiring feedback information pertaining to operation of an impeller of the snow removal vehicle, analyzing the feedback information with an electronic signal processor, and controlling forward movement of the snow removal vehicle based on the feedback information.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENTS

Figure 1:
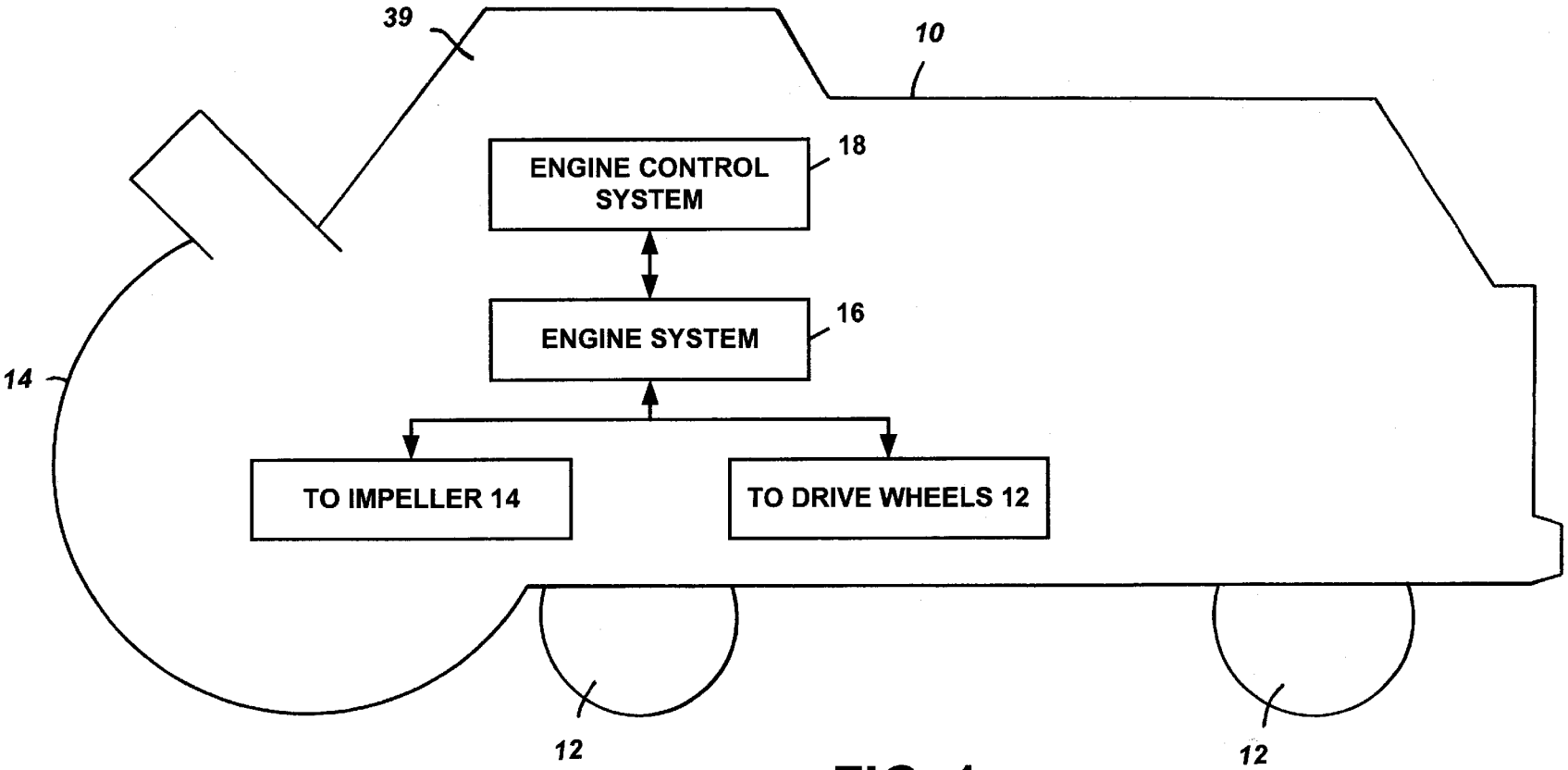
FIG. 1 is a schematic view of a snow removal vehicle with a control system according to a preferred embodiment of the invention.

Referring now to FIG. 1, a schematic diagram of a snow removal vehicle 10 is illustrated. The snow removal vehicle 10 comprises a plurality of drive wheels 12, an impeller 14, an engine system 16 that drives the drive wheels 12 and the impeller 14, and an engine control system 18 that controls the engine system 16.

Figure 2:
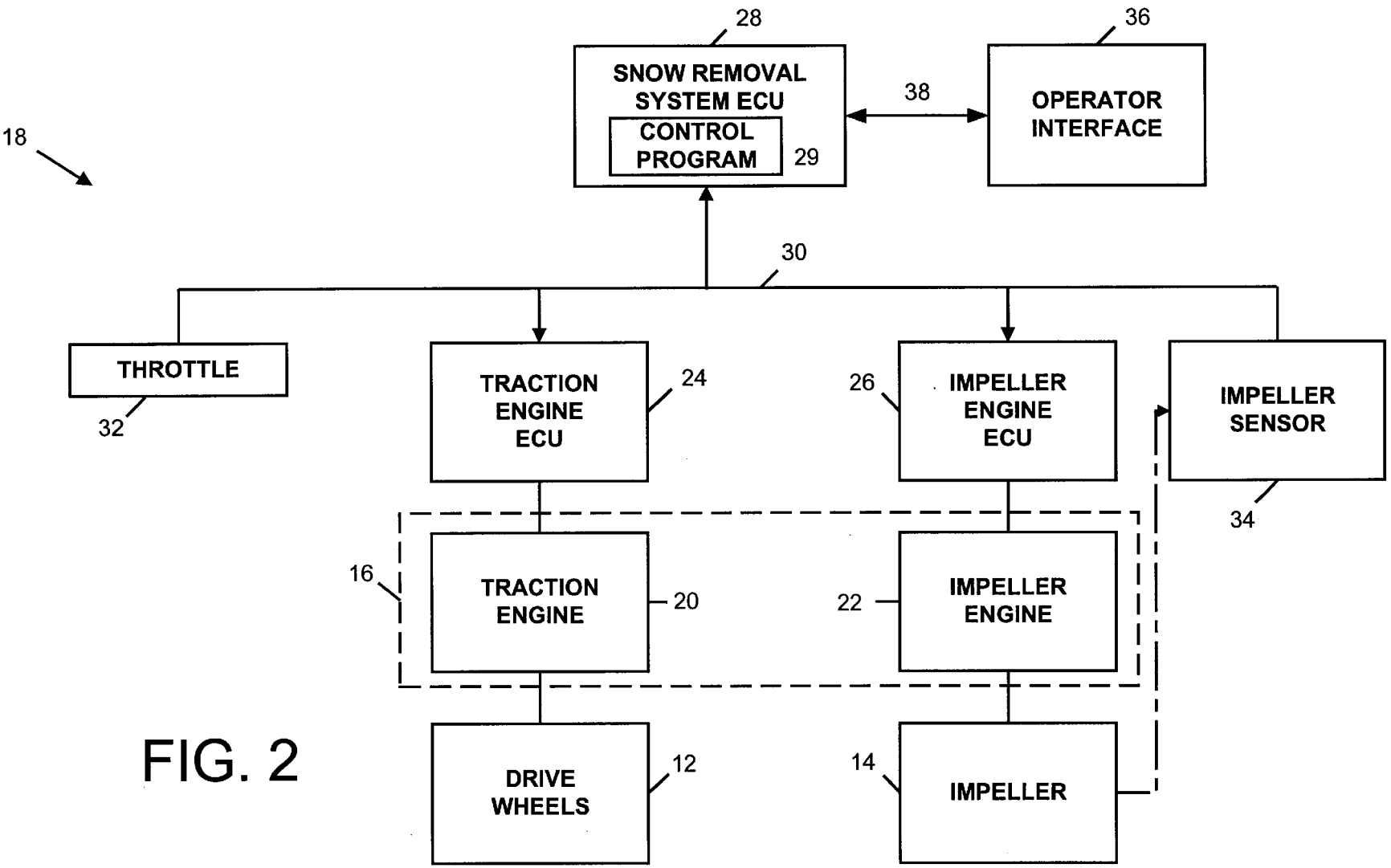
FIG. 2 is a block diagram showing the control system of FIG. 1 in greater detail.

The components 12–18 are shown in greater detail in FIG. 2. Referring now to FIG. 2, the engine system 16 preferably includes separate engines for the drive wheels 12 and the impeller 14. Thus, the drive wheels 12 are coupled to and are driven by a traction engine 20, and the impeller 14 is coupled to and is driven by an impeller engine 22. Of course, it would also be possible for the engine system 16 to comprise only a single engine that drives both the drive wheels 12 and the impeller 14, or to comprise more than two engines working in tandem. However, the use of two engines is the preferred arrangement.

The control system 18 further includes a plurality of electronic control units 24–28, a network communication link 30 that couples the electronic control units 24–28, a throttle 32, an impeller sensor 34, and an operator interface 36. The electronic control unit (ECU) 24 is coupled to the traction engine 20 and therefore is referred to hereafter as the traction engine ECU. The traction engine ECU 24 controls the operation of the traction engine 20, and is coupled to a throttle 32 used to acquire an operator input pertaining to the speed and acceleration conditions desired by the operator. The throttle 32 may be provided in the form of a floor-mounted throttle pedal. In FIG. 2, the throttle 32 is shown to be coupled to the traction engine ECU 24 by way of the communication link 30 which may, for example, be an SAE (Society of Automotive Engineers) J1939 communication link. However, the throttle 32 could also be hardwired to the traction engine ECU 24.

The ECU 26 is coupled to the impeller engine 22, and therefore is referred to hereafter as the impeller engine ECU. The impeller engine ECU 26 controls the operation of the impeller engine 22 which drives the impeller 14.

The ECU 28 is coupled to the traction engine ECU 24 and the impeller engine ECU 26 by way of the communication link 30, and provides for overall control of the engines 20 and 22. The ECU 28 is hereafter referred to as the snow removal system ECU or system ECU. Conceivably, rather than using three separate electronic control units, it would also be possible to use a smaller or larger number of electronic control units. Commercially available engines are typically provided with electronic control units, however, and it is desirable for sake of convenience to simply use the electronic control units provided by the manufacturer with the engines 20 and 22 and to implement additional functionality via an additional ECU in the manner illustrated. Electronic control units provided by engine manufacturers are typically microprocessor-based devices that include a control program (not illustrated) that is executable to control the associated engine, and that are capable of being coupled to a network communication link (e.g., J1939) to interface with other vehicle devices.

The system ECU 28 is coupled to an impeller sensor 34 which is used to acquire information pertaining to the operation of the impeller 14. For example, the impeller sensor 34 may be a pressure transducer that is coupled to sense pressure within a hydraulic system that couples the impeller engine 22 to the impeller 14. Again, in FIG. 2, the sensor 34 is shown to be coupled to the system ECU 24 by way of the network communication link 30. However, the impeller sensor 34 could also be hardwired to the system ECU 28.

Figure 3:
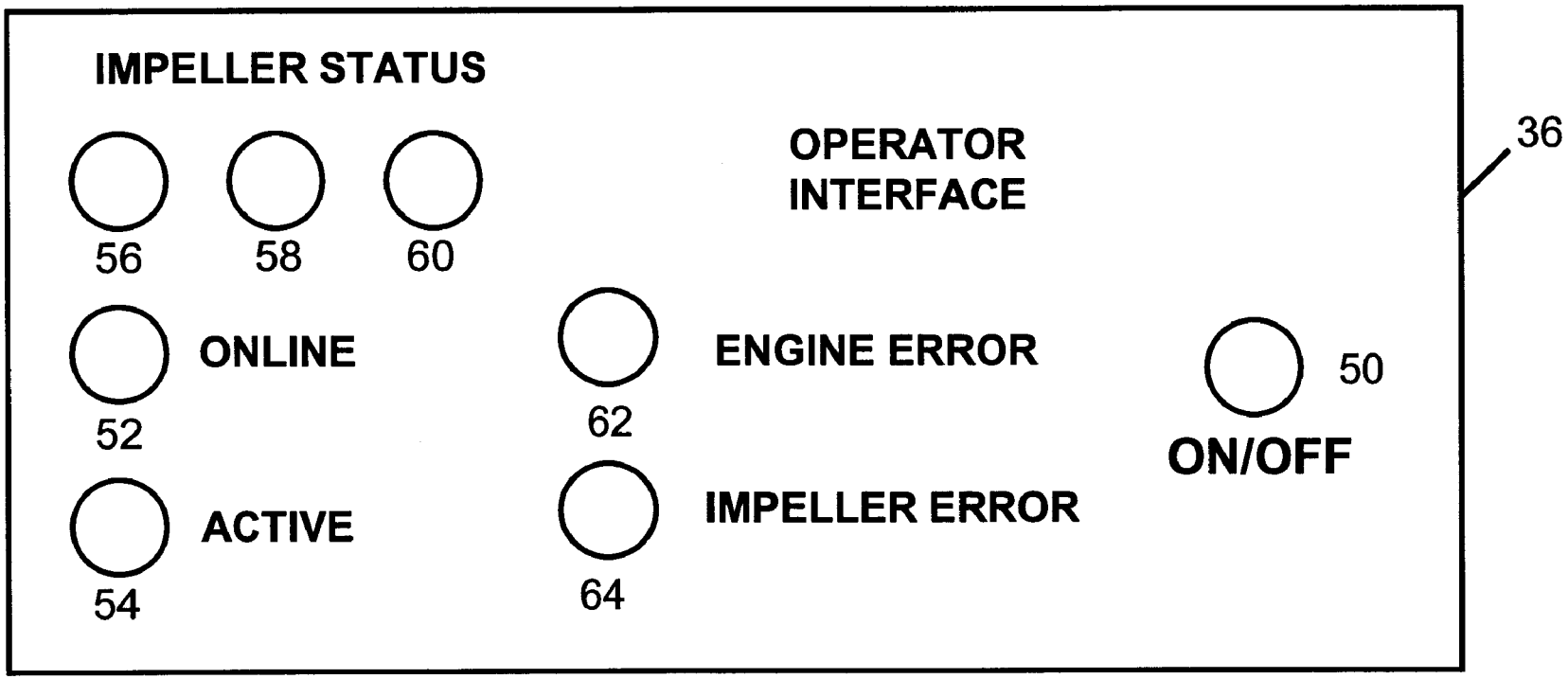
FIG. 3 shows a display of the control system of FIG. 1 in greater detail.

The system ECU 28 is also coupled to an operator interface 36 by way of a hardwired communication link 38, which in practice may comprise individual wires connected to respective input/output devices (switches/indicators) which form the operator interface 36. Referring now to FIG. 3, the operator interface 36 is shown in greater detail. The operator interface 36, which may be mounted in an operator compartment 39 of the vehicle 10, preferably comprises a switch 50 and a plurality of indicators 52–64. The switch 50 is an on/off switch and controls whether the control system 18 is engaged, giving the operator the option to disengage the control system 18 and operate the vehicle 10 without the aid of the control system 18. The indicators 52–64 are preferably light emitting diodes (LEDs). The indicator 52 indicates whether the switch 50 is on or off, that is, whether the control system 18 is engaged or on-line. The remaining indicators 54–64 are discussed in greater detail in conjunction with signal flow diagram of FIG. 4.

In practice, the system ECU 28 is preferably a microprocessor-based device that executes a control program 29. The system ECU 28 includes a communication interface (e.g., a plurality of discrete inputs and outputs) for connection to the hardwired communication link 38 that connects the system ECU 28 with the operator interface 36. The system ECU 28 also includes a communication interface for connection to the network communication link 30.

Figure 4:
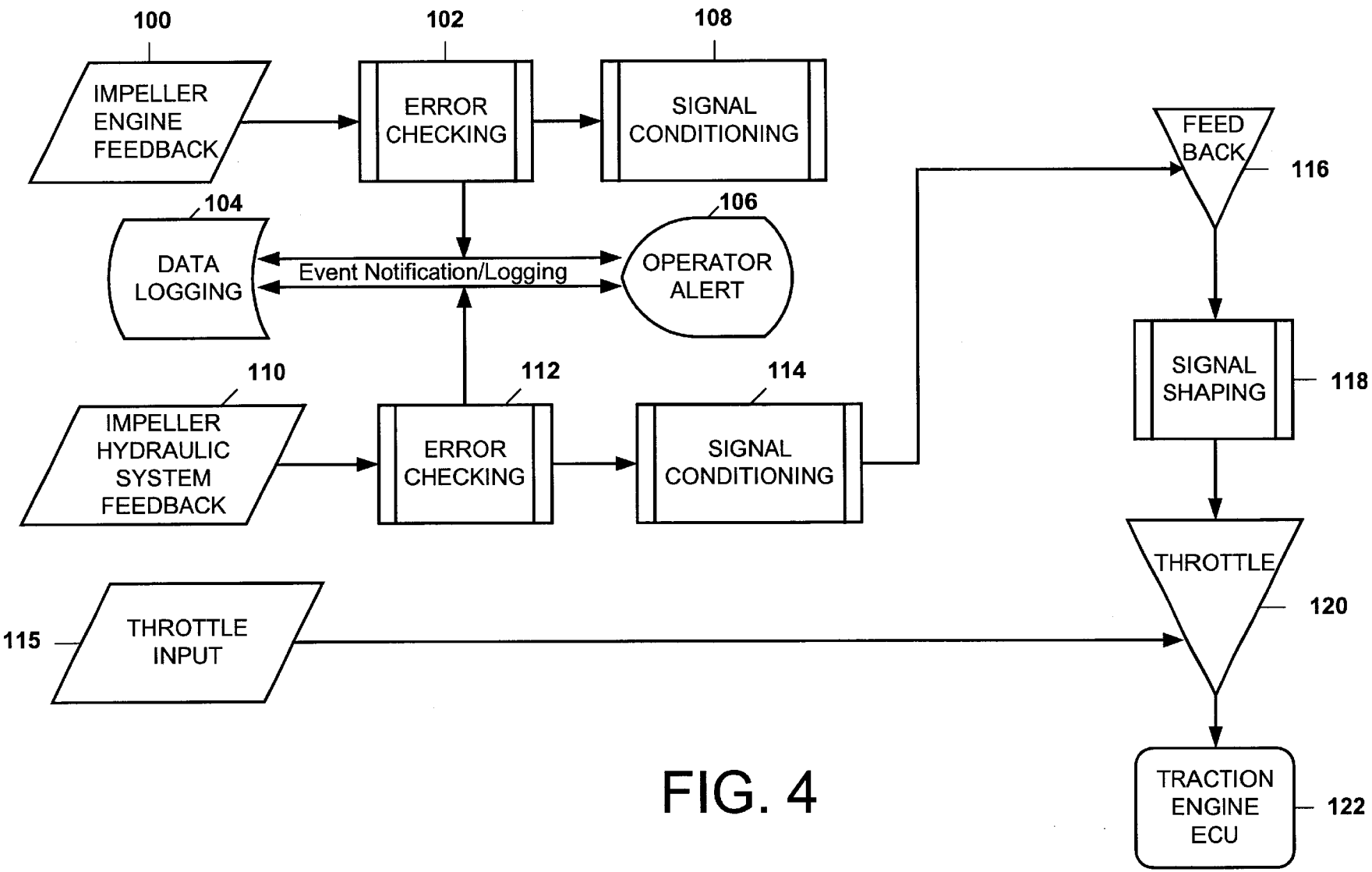
FIG. 4 is a signal flow diagram showing the operation of the control system of FIG. 1.

Referring now to FIG. 4, a signal flow diagram showing the operation of the control unit 28 is illustrated. The signal processing that is shown in FIG. 3 is implemented by way of execution of the control program 29. The control program 29 is used to maintain the snow removal vehicle 10 operating at maximum efficiency. To this end, the control program 29 preferably operates to cause the snow removal vehicle 10 to move forward in accordance with the throttle command provided by the operator during normal operating conditions, but operates to reduce the throttle command provided by the operator when necessary to avoid impeller stall conditions.

The control program 29 receives inputs from three sources. The first input, received at block 100, is a first feedback parameter pertaining to a first operational parameter of the impeller 14. The first feedback parameter preferably pertains to the impeller engine 22, for example, percent engine loading. In this event, the feedback information may be acquired from the impeller engine control unit 26 upon being queried for such information by the system ECU 28. The impeller engine feedback information is then provided to an error checking block 102 in which error checking is performed to ensure that the feedback information received from the impeller engine control unit 26 is valid. For example, the error checking may be performed based upon recent previous feedback information received from the impeller engine control unit 26 for the same parameter and/or based on other known operational limits. If the impeller sensor malfunctions, the control system 18 still operates but it only makes decisions based on the percent engine loading.

The feedback information from the error checking block 102 is transmitted to a data logging block 104 and an operator alert block 106. The data logging block 104 stores feedback information at frequent, periodic intervals to maintain a running log of the feedback information and thereby promote system troubleshooting should such troubleshooting be necessary. If desired, the running log may also store information pertaining to other parameters of either the traction engine 20 or the impeller engine 22 after appropriate error checking as previously described.

The operator alert block 106 notifies the operator if the error checking block 102 detects an error in the feedback information received from the impeller engine control unit 26. The operator alert is provided by way of the engine error indicator 62 located on the operator interface 36. Thus, if the impeller engine ECU 26 stops providing valid percent engine loading information, the error indicator 62 will illuminate.

After the error checking is performed at block 102, signal conditioning is performed at block 108. The signal conditioning at block 108 conditions the information received at block 100, for example, to implement averaging or hysteresis functions.

The second input to the control program 29, received at block 110, is a second feedback parameter pertaining to a second operational parameter of the impeller 14. Preferably, the second operational parameter pertains to a pressure sensed in a hydraulic system that couples the impeller engine 22 to the impeller 14. In this event, the impeller sensor 34 is a pressure sensor from which the sensed pressure is received at block 116.

Error checking is performed at block 112 in the same manner as described in connection with block 102, with the output of the error checking block 112 being provided to the data logging block 104 and the operator alert block 106. In this case, the operator alert block 106 notifies the operator if the error checking block 102 detects an error in the feedback information received from the impeller sensor 34. The operator alert is provided by way of the impeller error indicator 64 located on the operator interface 36. Thus, if it is determined that the impeller sensor 34 is not providing valid hydraulic pressure information, the error indicator 64 will illuminate. Signal conditioning is performed at block 114 to convert the voltage signal provided by the impeller sensor 34 into a format that has units of pounds per square inch.

In addition to or instead of hydraulic pressure and percent engine pressure, other parameters could also be acquired and used as feedback parameters. For example, the torque applied by the impeller engine 22 in driving the impeller 14 could be used by implementing the impeller sensor 34 in the form of a toque sensor rather than a pressure sensor. Alternatively, the angular velocity (e.g., revolutions per minute) of the impeller 14 could be used as a feedback parameter by querying the impeller engine ECU 26 for velocity information. It should also be apparent that any combination of feedback from ECUs and discrete sensors is possible.

The third input to the control program 29, received at block 115, is an operator throttle command received from the throttle 32. As previously indicated, the control program 29 preferably provides the traction engine ECU 24 with the full throttle command provided by the operator during normal operating conditions, but operates to provide the traction engine ECU 24 with a reduced throttle command when necessary to prevent impeller stall conditions. (For safety reasons, it is typically desirable to limit the speed of the snow removal vehicle 10 to that speed commanded by the operator by way of the throttle 32.) This portion of the control program is implemented at blocks 116–120.

The decision block 116 receives the error-checked, reformatted feedback signals from the input blocks 100 and 110. At the decision block 116, the feedback signals are analyzed and it is determined whether to modify the operation of the engine system 16 based on the received feedback information and, in particular, whether to reduce (or otherwise modify) the throttle command provided by the operator.

This determination is made by ascertaining whether either of he first and second feedback parameters exceeds a predefined threshold. For example, percent engine loading of the impeller engine 22 is one stall condition that may be monitored. Thus, the decision block 116 may decide to reduce the throttle command if the percent engine loading exceeds a predetermined level. By way of example, a level that is within the range of ninety to ninety-seven percent (e.g., 95%) may be chosen.

Likewise, hydraulic systems typically have a relief valve set at a known pressure. For example, if the relief valve is set at 5000 psi, thereby establishing 5000 psi as an impeller stall condition, then 4500 psi may be chosen as the predefined threshold. In this event, it is determined at decision block 116 to modify the throttle command if hydraulic pressure meets or exceeds 4500 psi.

Assuming it is determined at decision block 116 to reduce the throttle command provided to the traction engine ECU 24 by the operator, then the signal shaping block 118 generates a command to reduce the throttle command by a predetermined percentage. The throttle command produced by the signal shaping block 118 is a command that is recognizable by the traction engine ECU 24 as a throttle command input. Thus, when it is determined that the snow removal vehicle 10 is operating near one or more impeller stall conditions (e.g., percent engine loading too high, or hydraulic pressure too high), the throttle command is automatically reduced by a predetermined percentage to avoid impeller stalling. If the first throttle reduction is not sufficient, then further iterations of this process occur until the vehicle 10 is brought to an operating point that is below impeller stall conditions (e.g., below 95 percent engine loading and below 4500 psi hydraulic pressure). When none of the feedback parameters indicates that the vehicle is near impeller stalling, then the output of the signal conditioning block 118 is simply a null signal.

At the decision block 120, either the throttle command from either the throttle 32 or the throttle command from the signal shaping block 118 is selected. If the throttle command from the signal shaping block 118 is active, then it is selected. Otherwise, if the throttle command from the signal shaping block 118 is null, then the throttle command from the throttle 32 is selected.

At block 122, the throttle command output of the block 120 is transmitted to and utilized by the traction engine ECU 24. Assuming that the output of the signal shaping block 118 is active, then the forward velocity of the snow removal vehicle 10 is reduced. In turn, this reduces the snow intake rate into the impeller 14 which thereby avoids impeller stalling. The control system 18 then continues to monitor vehicle status and continues to decrease the throttle command as necessary until the impeller is no longer at or near stall conditions.

System status during this process may be displayed to the operator by way of the operator interface 36. The indicators 56–60 are impeller status indicators. For example, the indicator 56 may be a green indicator, indicating that impeller 14 is in an acceptable operating region and is not in danger of stalling. The indicator 58 may be a yellow indicator and may indicate that the impeller 14 is nearing stall conditions (e.g., hydraulic pressure above 4500 psi and/or percent engine loading above 95 percent). The indicator 60 may be a red indicator and may indicate that impeller 14 is at or above a stall condition (e.g., hydraulic pressure above 5000 psi or percent engine load above one-hundred percent). The indicator 54 indicates whether the control system is in an active mode in which the control system is reducing the throttle command provided to the traction engine control unit 24 to avoid impeller stalling. Typically, the indicators 54 and 58 or 54 and 60 illuminate concurrently. In this regard, it may be noted that it is sometimes possible for a snow removal vehicle to operate for short periods of time even though impeller stall conditions have been met, so long as the impeller stall conditions are not met for extended durations.

The preferred embodiment described herein improves the operation of snow removal vehicles by maintaining vehicle operation such that the vehicle removes the maximum amount of snow that it is capable of removing, while avoiding the risk of the impeller stalling. This allows snow removal vehicles to remove more snow per hour, that is, to operate at maximum efficiency.

Many other changes and modifications may be made to the present invention without departing from the spirit thereof. The scope of these and other changes will become apparent from the appended claims.

What is claimed is:

1. A snow removal vehicle comprising:

an impeller;

an engine system; and an engine control system, said engine control system receiving feedback information pertaining to operation of said impeller, said engine control system controlling said engine system based on said feedback information, said engine control system comprising a microprocessor-based control unit, and wherein said feedback information is obtained from said microprocessor-based control unit.

2. A snow removal vehicle according to claim 1, wherein said engine control system controls said engine system based on said feedback information to avoid stalling of said impeller.

3. A snow removal vehicle according to claim 2, wherein said engine control system causes said engine system to reduce a forward velocity of said snow removal vehicle to avoid stalling of said impeller.

4. A snow removal vehicle according to claim 2, wherein said engine control system causes said engine system to drive forward movement of said snow removal vehicle in accordance with a throttle command provided by an operator when said snow removal vehicle is not operating near an impeller stall condition, and operates to provide a throttle command less than that provided by the operator when necessary to avoid impeller stall conditions.

5. A snow removal vehicle according to claim 1, wherein said feedback information is obtained from a pressure censor that senses a pressure within a hydraulic system that is coupled between said engine system and said impeller.

6. A snow removal vehicle comprising:

an impeller;

an engine system, said engine system including a traction engine, said traction engine being coupled to drive wheels of said snow removal vehicle, and said traction engine being adapted to drive said drive wheels to drive movement of said snow removal vehicle, and an impeller engine, said impeller engine being coupled to said impeller, and said impeller engine being adapted to drive said impeller to drive snow removal; and an engine control system, said engine control system receiving feedback information pertaining to operation of said impeller, and said engine control system controlling said engine system based on said feedback information, said engine control system including a network communication link, a microprocessor-based traction engine control unit, said traction engine control unit being coupled to said traction engine and being adapted to control said traction engine, a microprocessor-based impeller engine control unit, said impeller engine control unit being coupled to said impeller engine and being adapted to control said impeller engine, and a microprocessor-based system control unit, said system control unit being coupled to said traction engine control unit and said impeller engine control unit by way of said network communication link, said system control unit being adapted to receive said feedback information pertaining to said operation of said impeller, and to generate a control signal for said traction engine control unit based on said feedback information.

7. A snow removal vehicle according to claim 6, wherein said feedback information is received from said impeller engine control unit.

8. A snow removal vehicle according to claim 6, wherein said feedback information pertains to percent engine loading of said impeller engine.

9. A snow removal vehicle according to claim 6, wherein said feedback information pertains to a torque applied by said impeller engine.

10. A snow removal vehicle according to claim 6, wherein said feedback information pertains to an angular velocity of said impeller engine.

11. A snow removal vehicle according to claim 6, wherein said snow removal vehicle is a driver-operated vehicle and includes a driver compartment that is adapted to carry a human driver that operates said snow removal vehicle.

12. A snow removal vehicle according to claim 6, wherein said engine system drives forward movement of said snow removal vehicle and wherein said engine control system controls forward movement of said snow removal vehicle based on said feedback information.

13. A method of controlling a snow removal vehicle comprising:

acquiring feedback information pertaining to operation of an impeller of said snow removal vehicle;

analyzing said feedback information with an electronic signal processor; and controlling forward movement of said snow removal vehicle based on said feedback information.

14. A method according to claim 13 wherein, during said controlling step, a rate of said forward movement of said snow removal vehicle is reduced to avoid impeller stalling in response to said feedback information indicating that said snow removal vehicle is operating near an impeller stall condition.

15. A method according to claim 14, wherein said feedback information pertains to loading of an engine that drives said impeller.

16. A method according to claim 14, wherein said feedback information pertains to pressure in a hydraulic system that is coupled between said impeller and an impeller engine.

17. A method according to claim 14, wherein said feedback information pertains to a torque applied by an engine that drives said impeller.

18. A method according to claim 14, wherein said feedback information pertains to an angular velocity of an engine that drives said impeller.

19. A method of controlling a snow removal vehicle comprising:

acquiring feedback information pertaining to operation of an impeller of said snow removal vehicle;

transmitting said feedback information to a microprocessor-based system control unit;

processing said feedback information at said system control unit, including determining that said feedback information indicates that said impeller is operating near a stall condition; and reducing a rate of forward movement of said snow removal vehicle in response to said feedback information indicating that said impeller is operating near said stall condition, including generating, at said system control unit, a control signal microprocessor-based traction engine control unit, said traction engine control unit being coupled to and controlling an engine that drives forward movement of said snow removal vehicle, transmitting said control signal from said system control unit to said traction engine control unit by way of a network communication link, and utilizing said control signal at said traction engine control unit to reduce said rate of said forward movement of said snow removal vehicle.

20. A method according to claim 19, wherein said feedback information is acquired from a microprocessor-based impeller engine control unit that is coupled to and controls an engine that drives said impeller, and wherein said feedback information is transmitted by way of said network communication link.

* * * * *

UNITED STATES PATENT AND TRADEMARK OFFICE

CERTIFICATE OF CORRECTION

PATENT NO. : 6,266,598 B1
DATED : July 24, 2001
INVENTOR(S) : Duane R. Pillar; Bradley C. Squires It is certified that error appears in the above-identified patent and that said Letters Patent is hereby corrected as shown below:

Column 7,
Line 10, replace "censor" with -- sensor --.

Column 8,
Line 48, insert -- for a -- after "signal".

Signed and Sealed this

Twenty-fifth Day of December, 2001

*Attest:*

*Attesting Officer*

JAMES E. ROGAN
*Director of the United States Patent and Trademark Office*